US006127036A

United States Patent [19]

Xue et al.

[11] Patent Number: 6,127,036

[45] Date of Patent: Oct. 3, 2000

[54] PRODUCTION OF ENGINEERING FIBERS BY FORMATION OF POLYMERS WITHIN THE CHANNELS OF WICKING FIBERS

[75] Inventors: Lixin Xue, Morristown; Ronald Rohrbach, Flemington; Daniel Bause, Morristown; Peter Unger, Convent Station; Russell Dondero, N. Arlington, all of N.J.; Gordon Jones, Toledo, Ohio

[73] Assignee: AlliedSignal Inc., Morristown, N.J.

[21] Appl. No.: 08/958,488

[22] Filed: Oct. 27, 1997

[51] Int. Cl.[7] ..... D02G 3/00

[52] U.S. Cl. ..... 428/400; 428/398; 428/397

[58] Field of Search ..... 428/376, 39.8, 428/397, 400

[56] References Cited

U.S. PATENT DOCUMENTS

| | | | |
|---|---|---|---|
| 5,484,650 | 1/1996 | Hernandez | 428/398 |
| 5,527,611 | 6/1996 | Hernandez | 428/398 |
| 5,744,236 | 4/1998 | Rohrbach et al. | 428/397 |

*Primary Examiner*—Newton Edwards

[57] ABSTRACT

The internal channels (22) of wicking fibers (20) are filled with a selected liquid (18) form of a prepolymerized polymer or monomers and related reagents and then the polymerization reaction is carried out under suitable conditions to form a fiber with desired properties. Fibers with the properties of the formed polymeric products are conveniently obtained thereafter. This provides a convenient way to obtain engineered fibers by directly polymerizing the monomers in the wicking fiber (20) channels (22). The wicking fibers (20) include internal longitudinal cavities or channels (22) each with a relatively small longitudinal extending opening (24). The wicking fibers (20) are filled with the selected liquid through capillary action by which the individual wicking fibers (20) rapidly draw the selected liquid, with which they comes into contact, through the internal cavities (22). The selected liquid remains within the wicking fiber cavities (22) and generally does not enter the space between the wicking fibers yet through the longitudinal openings (24) the liquid is in full communication with the environment surrounding the wicking fiber (20). The formed solid polymer is retained in the channels (22) of the wicking fiber (20).

6 Claims, 3 Drawing Sheets

PRODUCTION OF ENGINEERING FIBERS BY FORMATION OF POLYMERS WITHIN THE CHANNELS OF WICKING FIBERS

BACKGROUND OF THE INVENTION

1. Field of the Invention

This invention relates to fibers and more particularly to engineering fibers produced by the formation or deposition of a polymer inside wicking fiber channels.

2. Description of Prior Art

It is know to produce fibers having many different characteristics such as tensile strength, conductivity, elasticity, shape memory, etc. However, many polymers with very desirable properties are difficult or even impossible to process into fibers in any conventional way due to their characteristic thermoforming properties or insolubility, thus their use in a fibrous form can not be realized or produced in an economical fashion. Materials need to have a sufficient minimum robustness to have any practical application, extreme brittleness and low cohesive strength can render a material unsuitable for any application. Consequently, fiber research has focused on developing new monomers/polymers which simultaneously have the desired physical properties and robustness. Many potential candidates lack this robustness despite the fact they have the appropriate physical desired characteristics and therefore their desired properties never realized.

SUMMARY OF THE INVENTION

In this invention we fill the internal channels of wicking fibers with a prepolymerized polymer or monomers and related reagents and then carry out the polymerization reaction under suitable conditions. This provides a convenient way to obtain engineering fibers by directly carrying out the polymerization reaction in the wicking fiber channels. Fibers with the properties of the formed polymeric products are conveniently obtained thereafter. Conducting fibers of pyrrole were easily synthesized by reacting pyrrole monomers with FeCl3 in the wicking fibers.

Wicking fibers have the ability to carry a liquid along their surface and to retain the liquid so it is not easily dislodged. Wicking fibers such as those disclosed in U.S. Pat. No. 5,057,368 are very small and well suited to the practice of the present invention. These generally hollow wicking fibers include internal longitudinal cavities each with a relatively small longitudinal opening extending to their outer surface. Through capillary action the individual wicking fibers rapidly draw the selected liquid, with which it comes into contact, through the internal cavities. The selected liquid, which can be monomers and related reagents, remains within the wicking fiber cavities and generally does not enter the space between the wicking fibers. The wicking fibers have the ability to hold more than their own weight of chemicals inside their channels while leaving adequate openings for further interaction with the environment.

This invention can be use in a customized fashion to produce electrical and thermal conducting fibers, high modulus fibers, high strength fibers, chromatographic fibers, super strong fibers, sensors, optical filters and their woven or non-woven products.

BRIEF DESCRIPTION OF DRAWINGS

For a better understanding of the invention reference may be had to the preferred embodiments exemplary of the inventions shown in the accompanying drawings in which.

DETAILED DESCRIPTION OF THE PREFERRED EMBODIMENTS

Figure 1:
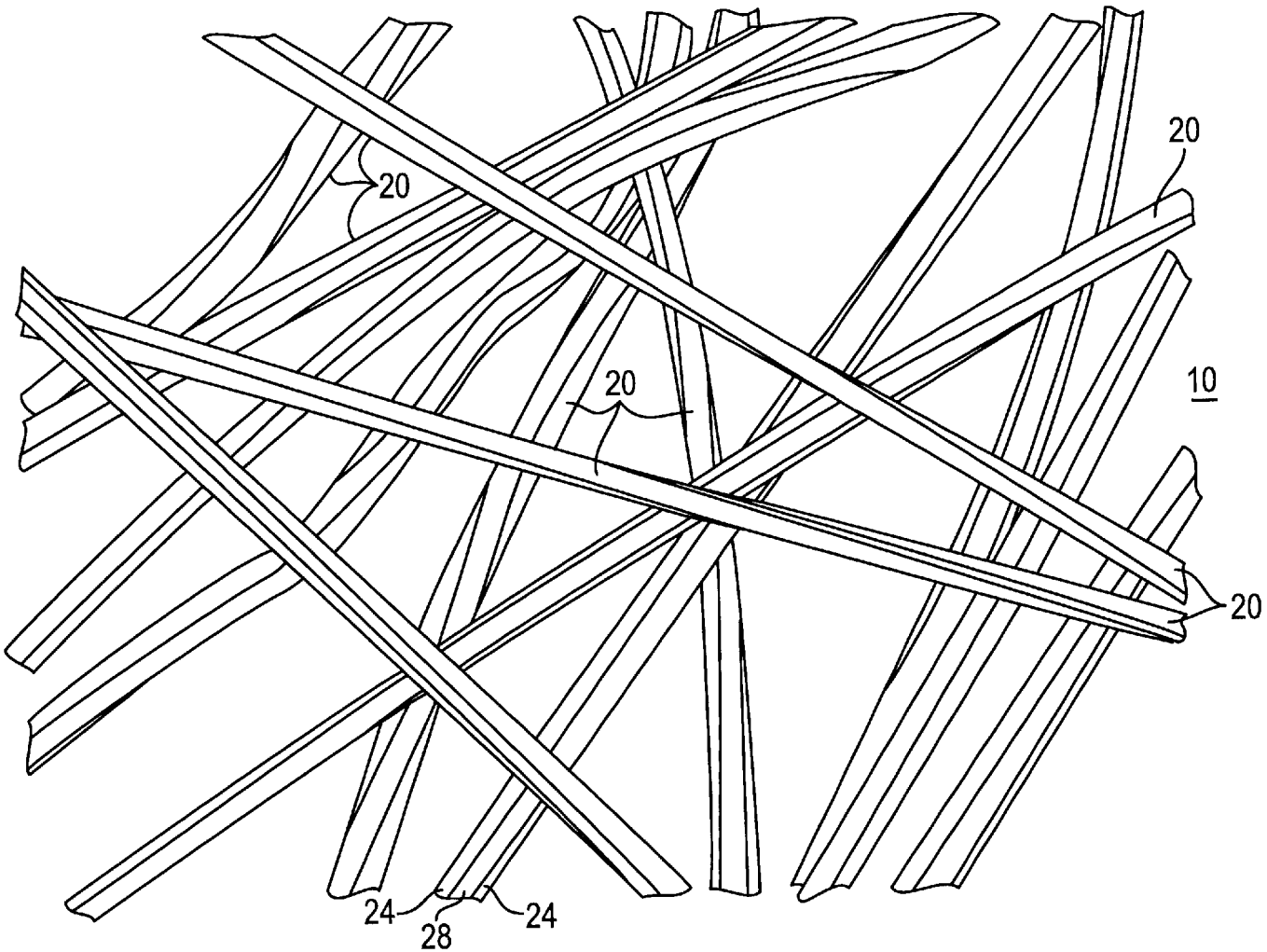
FIG. 1 is an enlarged view of a portion of a mat made of fibers which are particularly suitable for practicing the present invention.
Figure 2:
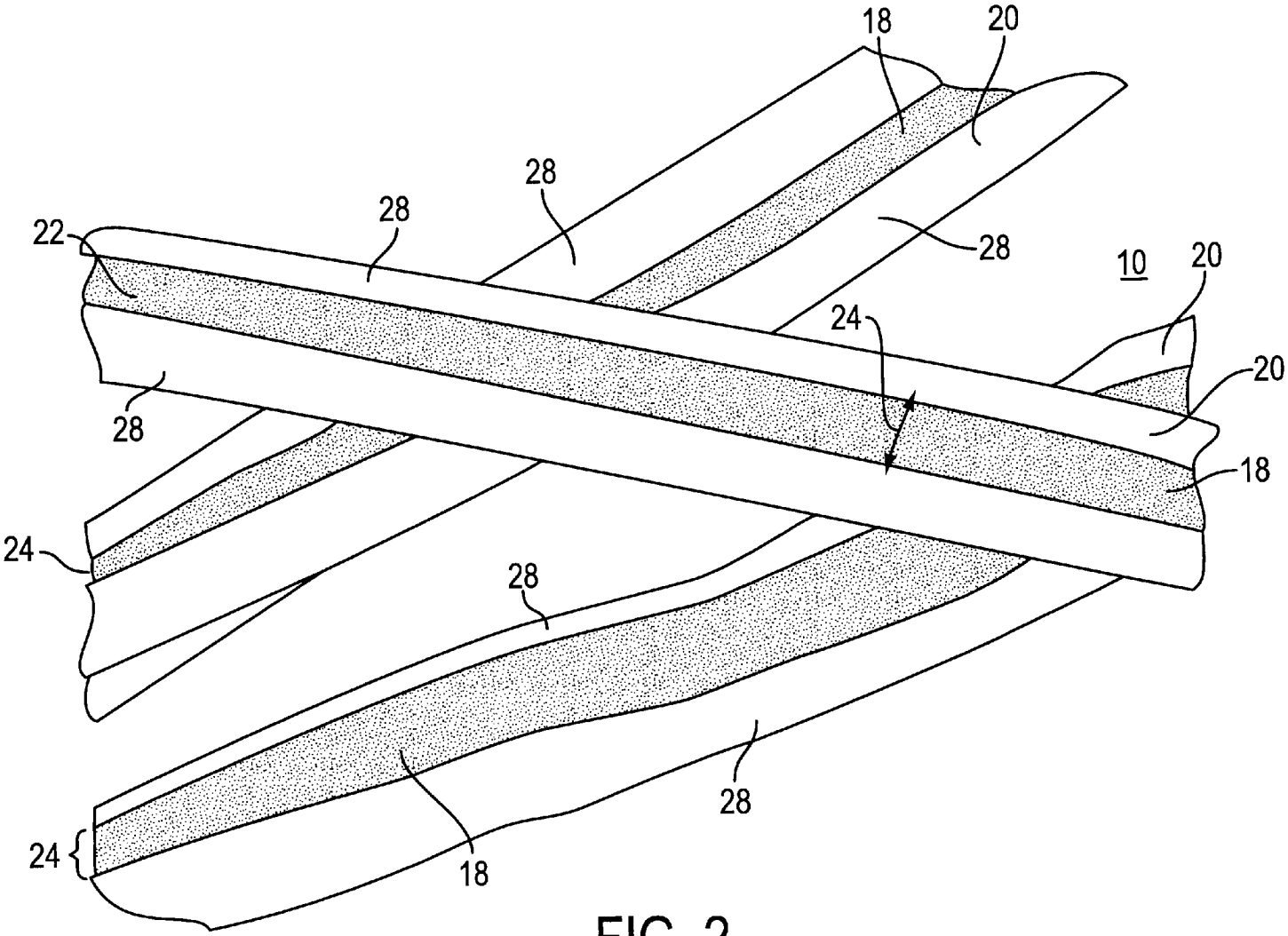
FIG. 2 is an enlarged view of several of the elongated wicking fibers shown in FIG. 1 showing the liquid monomers and related reagents within the longitudinally extending fiber cavities; and, FIG. 3 is an enlarged view of a wicking fiber which is particularly suitable for practicing the present invention.
Figure 3:
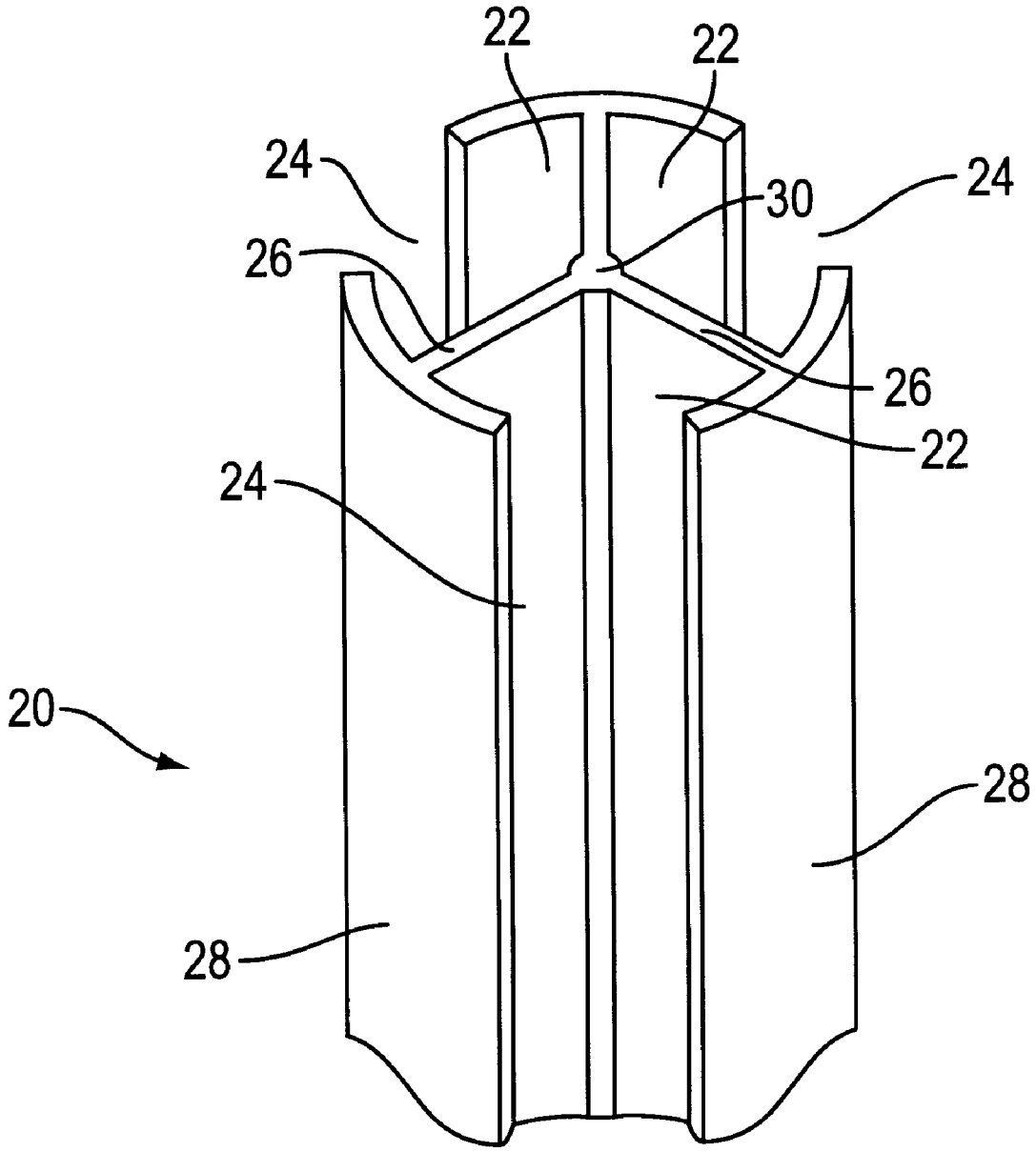

Referring now to the drawings and FIGS. 1 and 2 in particular there is shown a fiber mat 10 formed from wicking fibers 20 which are particularly suit for practicing the present invention. A cross-section of one of the wicking fibers 20 is shown in FIG. 3. As shown in FIG. 2 a selected liquid 18 consisting of monomers and related reagents or already polymerized materials are disposed in the internal channels of the wicking fibers 20. The polymerization reaction is then carried out under suitable conditions to form the desired engineered fiber.

A wicking fiber 20 which is particularly suitable for practicing this invention is disclosed in U.S. Pat. No. 5,057,368. This patent discloses a trilobal or quadrilobal fiber formed from thermoplastic polymers wherein the fiber has a cross-section with a central core and three or four T-shaped lobes 26. The legs of the lobes intersect at the core so that the angle between the legs of adjacent lobes is from about 80 degrees to 130 degrees. The thermoplastic polymer is typically a polyamide, a polyester, a polyolefin or a combination thereof. The wicking fiber as illustrated in FIG. 3 is formed as an extruded strand having three hollow interior longitudinally extending cavities 22 each of which communicates with the outer strand surface by way of longitudinal extending slots 24. The wicking fibers 20 are relatively small having a diameter of 30 to 250 microns. The capillary forces within the individual cavities 22 are so much greater than those external to the fiber 20 that the selected liquid 18, which can be monomers and related reagents, are readily wicked up the interior channels 22 of the fiber 20 without appreciable wetting of the external surfaces 28 or filling the inter wicking fiber voids. The fibers 20 strongly retain the selected liquid 18 through capillary action so that the fiber mat 12 is not wet to the touch and the selected liquid 18 will not shake off during handling or processing. In a fiber mat 10 of such wicking fibers 20 the area between the individual strands remains relatively free of the selected liquid 18 with which the internal cavities 22 of each fiber 20 are filled. The three T-Shaped cross-section segments may have their outer surface 28 curved, as shown, or straight. While the wicking fiber 20 is depicted as three lobed other number of lobes are suitable. In addition other external or internal wicking fibers with C-shaped or other cross sections may also be suitable for wicking the selected liquid 18 which will be processed into a solid polymer. These wicking fibers 20 have the ability to hold more than their weight of chemicals inside the channels 22 leaving adequate openings 24 for further interactions with the environment.

The specific shape of the wicking fibers is not important so long as the fibers selected can move the selected liquid 18, with which it comes into contact, along its surface and then hold the selected liquid 18 to its surface so that it is not easily displaced during processing.

The method of practicing the present invention should now be clear. The hollow portions 22 of the wicking fibers are impregnated with a selected liquid 18, including components which can be processed into a polymer having desirable properties. The polymerization reaction is then carried out under suitable conditions in the channels 22 to form fibers having the desired properties. This allows us to produce fibers 22 with polymers having desirable properties which are difficult to process into fibers in any conventional way due to their insolubility and/or thermosetting properties.

Conducting fibers of polypyrrole have been synthesized by polymerizing pyrrole with ferric chloride impregnated inside the channels 22 of the trilobal wicking fiber 20. Fibers with super mechanical strength might also be prepared by polymerization of cross-linkable monomers of various types inside the channels 22. Following are some examples which illustrate the present invention.

EXAMPLES

Examples-1–3 Formation of Polypyrrole Fibers

Example 1—from liquid phase:

Under nitrogen atmosphere, a trilobal wicking fiber pad 10 (0.221 g, 2 inches in diameter) was first impregnated with liquid pyrrole to 0.95 g and then soaked and squeezed in excess amount of 20% FeCl3 solution (about 3.5 g). When the fiber pad 10 turned completely black in about 10 minutes, the excess liquid was removed by careful squeezing. After washed in 50 ml of deionized water and dried in a evaporation oven at 93° C. for 20 minutes, the sample weighed 0.380 g. Under microscope, a homogenous black fiber mat of polypyrrole fiber can be clearly identified. The polypyrrole fiber was impregnated in the channels 22 of the wicking fiber 20. The conductivity of the impregnated fiber mat 10 was measure under 4-point probe method as 2.2 e–4 s/cm. The conductivity of the impregnated mats 10 described in these first three examples are sensitive to the contact between the fibers 20 in the mats 10 while carrying out this measurement. The number will be higher if the measurement is done on individual fiber 20.

Example 2—from gas phase:

A trilobal wicking fiber pad 10 (0.221 g, 2 inches in diameter) was first soaked and squeezed in excess amount of 20% FeCl3 solution and the excess was removed by careful squeezing. The obtained brownish pad 10 was first dried by blowing with 1.5 CFM nitrogen stream for 30 minutes and then exposed to saturate vapor of pyrrole carried by the same nitrogen stream which passed through a 2-necked container with liquid pyrrole. In about an hour, the wicking fiber pad 10 turned completely into the dark color of polypyrrole. After washing and drying as in example 1, the pad weighed 0.350 g and had a conductivity of 2.5 e–4 s/cm.

Example 3—enforced with graphite powder

A trilobal wicking fiber pad 10 (0.221 g, 2 inches in diameter) was first dry impregnated with graphite powder to 0.250 g. The conductivity of this impregnated mat 10 was determined as 1.5 e–5 s/cm. This mat was then soaked and squeezed in excess amount of 20% FeCl3 solution and the excess was removed by careful squeezing. The obtained pad 10 was first dried by blowing with 1.5 CFM nitrogen stream for 30 minutes and then exposed to saturate vapor of pyrrole carried by the same nitrogen stream which passed through a 2-necked container with liquid pyrrole. In about an hour, the wicking fiber pad 10 turned completely into the dark color of polypyrrole. After washing and drying as in example 1, the pad weighed 0.404 g and has a conductivity of 1.17 e–3 s/cm.

Example 4–5 Formation of Polyamide Fibers

The procedure to prepare an actively polymerizing solution is as disclosed in U.S. Pat. No. 5,106,560. Under dry nitrogen atmosphere, 4.2 g of CaCl2 was charged into a 100 ml tri-necked round bottom flask containing 50 g of anhydrous N-methyl pyrrolidone (NMP). The flask was then equipped with dry N2 flow, mechanical stirrer and heated to 90° C. under mechanical stirring until a clear solution was obtained. After cooling down under nitrogen to room temperature, 2.927 g of p-phenylene diamine was added with mixing to a pink solution. The resulted solution was further cooled down to 10° C. and added portion-by-portion with a total of 5.5 g of terephthaloyl chloride solid through a solid addition device under vigorous stirring in about 2 hours, so the internal temperature was less than 20° C. After the addition, the polymerization solution become very viscous in about 1 hour and was further diluted with 30 ml of NMP to be used.

Example 4—Static Impregnation 0.21 g of 3 denier polypropylene trilobal wicking fiber mat dipped and squeezed in the above solution under nitrogen purging. After excess amount of the solution was removed by careful squeezing, the resulting fiber bundle was left drying under nitrogen stream for overnight to a weight of 0.44 g. After drying, yellowish polyamide fibers formed inside the channels of the wicking fiber.

Example-5—Flowing Impregnation

Under dry nitrogen stream, a bundle of above fiber with 20 filaments was carefully pass through the above solution and wrapped on a glass core. The yellowish active polymerization solution was carried by the moving fiber inside the channel of the wicking fiber. After drying, yellowish polyamide fiber was formed inside the channels of the wicking fiber.

We claim:

1. A fiber comprising:

an elongated strand having therein at least one longitudinally extending open channel; and a polymer having desired properties disposed and permanently retained within said longitudinally extending open channel.

2. A fiber as claimed in claim 1 wherein said fiber has therein a plurality of longitudinally extending open channels.

3. A fiber as claimed in claim 1 wherein the diameter of said elongated strand is less than 250 microns and the width of said longitudinally extending open channel at the surface of the fiber is less than one half the strand diameter.

4. A fiber as claimed in claim 1 wherein said polymer is formed in said longitudinally extending open channel by introducing a selected monomer and its related reagents into said longitudinally extending open channel and carrying out a polymerization reaction under suitable conditions to form said polymer.

5. A fiber as claimed in claims 1 wherein said polymer is formed in said longitudinally extending open channel by introducing a selected liquid form of a prepolymer into said longitudinally extending open channel and carrying out a polymerization reaction under suitable conditions to form said polymer.

6. A fiber as claimed in claim 1 wherein said polymer is formed in said longitudinally extending open channel by introducing a selected liquid containing polymerized polymers into said longitudinally extending open channel and carrying out a reaction under suitable conditions to form said polymer.

* * * * *